US005816463A

United States Patent [19]

Echeverri

[11] Patent Number: 5,816,463

[45] Date of Patent: Oct. 6, 1998

[54] SPORTS PACK ATTACHABLE TO BLEACHERS/STADIUM SEATS

[76] Inventor: Susan J. Echeverri, 20822 N. 22nd Ave., Phoenix, Ariz. 85027

[21] Appl. No.: 739,059

[22] Filed: Oct. 28, 1996

[51] Int. Cl.[6] ..... B60R 7/00; B60R 9/00; B60R 11/00

[52] U.S. Cl. ..... 224/584; 224/153; 224/577; 224/580; 224/581; 224/268; 224/642; 224/645; 224/649

[58] Field of Search ..... 224/151, 153, 224/155, 577, 584, 580, 587, 268, 642, 645, 649; 190/8; 297/188.06, 183.5; 5/420, 653; 383/4

[56] References Cited

U.S. PATENT DOCUMENTS

| | | | |
|---|---|---|---|
| D. 357,609 | 4/1995 | Webb et al. | 5/653 |
| 2,105,319 | 1/1938 | Hedden et al. | 224/153 |
| 2,702,076 | 2/1955 | Beardsley et al. | 297/183.5 |
| 2,865,433 | 12/1958 | Warner | 5/653 |
| 4,318,502 | 3/1982 | Lowe et al. | 224/153 |
| 4,515,300 | 5/1985 | Cohen | 224/151 |
| 4,574,990 | 3/1986 | Remis | 224/255 |
| 4,604,987 | 8/1986 | Keltner | 5/653 |
| 4,776,503 | 10/1988 | Sink | 224/153 |
| 4,810,102 | 3/1989 | Norton | 383/4 |
| 4,854,637 | 8/1989 | McCree | 5/653 |
| 4,883,207 | 11/1989 | McArthur | 224/153 |
| 4,925,064 | 5/1990 | Comora | 224/155 |
| 4,940,173 | 7/1990 | Jacober | 224/153 |
| 4,945,589 | 8/1990 | Carey | 5/653 |
| 5,275,315 | 1/1994 | Carmack et al. | 224/151 |
| 5,407,111 | 4/1995 | Lanouette et al. | 224/151 |

*Primary Examiner*—David J. Walczak
*Assistant Examiner*—Timothy L. Maust
*Attorney, Agent, or Firm*—Cahill, Sutton & Thomas P.L.C.

[57] ABSTRACT

A pack for safely securing personal items below stadium seating at sporting events includes a flexible sack including one or more pockets that can be sealed by a closure flap. One of such pockets may be used to contain a seat cushion to be placed upon such stadium seating. A fastening system is provided for securing the flexible sack to the underside of the stadium seating. The fastening system may include hooked members secured by elastic straps to opposing ends of the pack. Alternatively, the fastening system may include straps secured to the sack and which extend around and above the stadium seat. The pack may include a handle, shoulder strap, or a pair of arm straps to aid in carrying the pack to or from a stadium.

9 Claims, 4 Drawing Sheets

FIG. 1
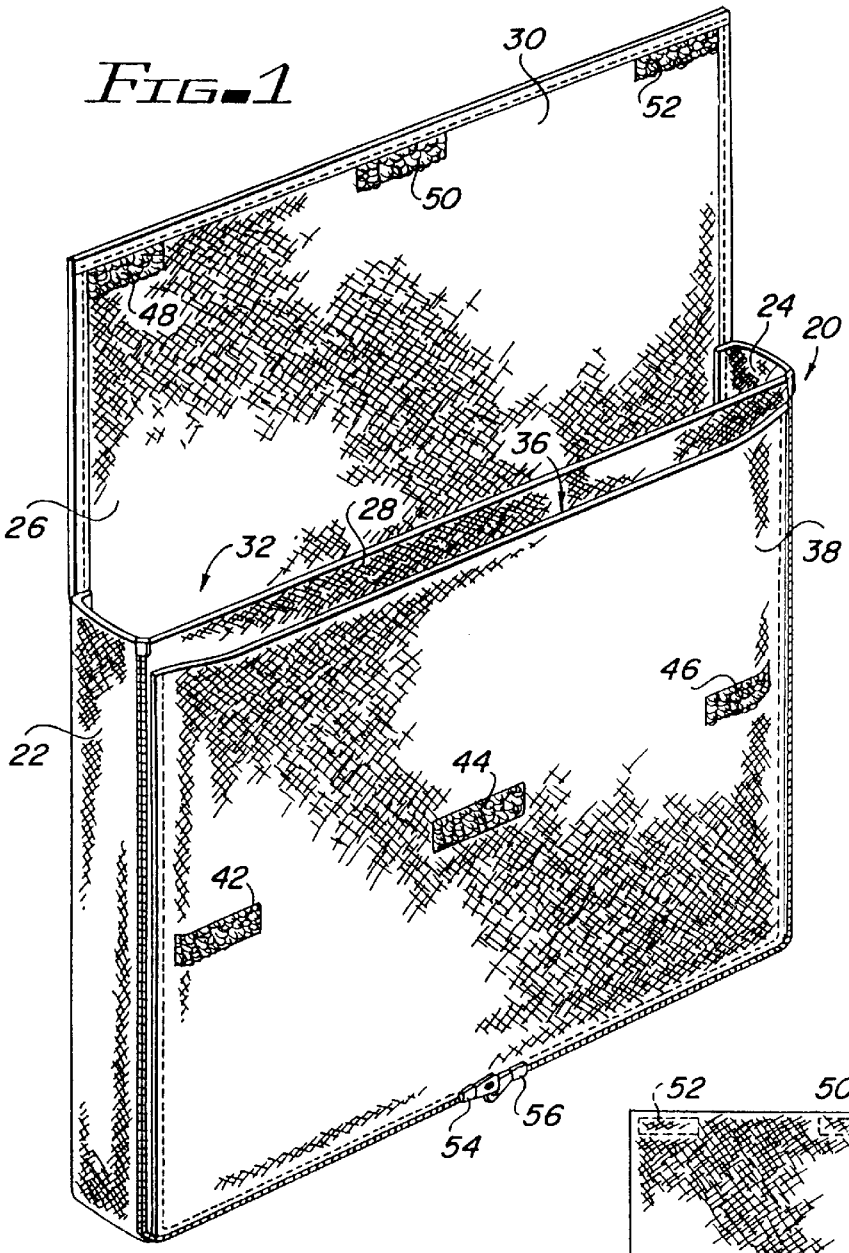
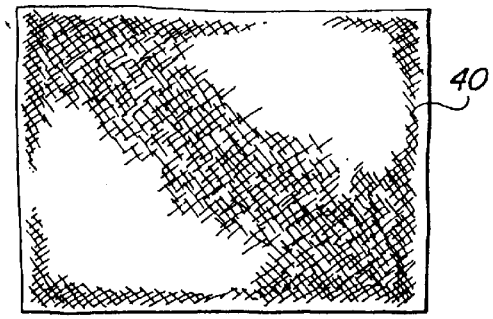
FIG. 3
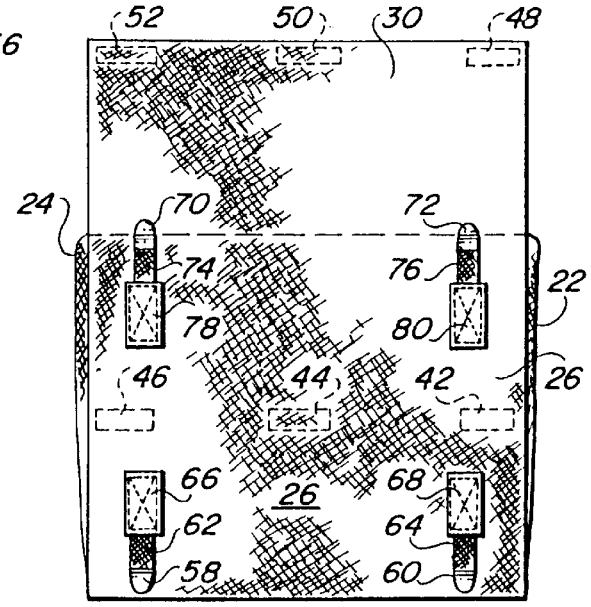
FIG. 2

SPORTS PACK ATTACHABLE TO BLEACHERS/STADIUM SEATS

BACKGROUND OF THE INVENTION

1. Field of the Invention

The present invention relates generally to packs for carrying and storing personal articles, and more specifically, to such a pack adapted for use at sporting events.

2. Description of the Relevant Art

Recreational activities for many people commonly include attendance at sporting events, such as baseball games, football games, basketball games, hockey games, etc. Increasing interest in such sporting events has sparked the expansion of additional teams within existing leagues, the creation of entirely new leagues, and the expansion of sporting stadiums. Overall attendance at sporting events is on the rise.

Spectators to such sporting events often bring a variety of personal items to the game, including such items as cameras, binoculars, jackets, sun block lotion, etc. for use during the game. In addition, many spectators purchase souvenirs, programs, and other memorabilia as a remembrance of their visit to the game. Typically, the only place to keep such items is under the spectator's seat. Unfortunately, the floor space below such seating is often sticky or dirty. In addition, beverages served to sporting fans at such games often spill onto the floor below the stadium seating. On occasion, spilled beer or other beverages can ruin those personal items kept under the seat by a spectator. Even if such personal items are kept in a conventional backpack or knapsack, the backpack or knapsack is typically kept on the floor, and accidental beverage spills can ruin both the backpack and its contents.

Seating within stadiums is often uncomfortable. For example, some stadium seating is merely an extended wooden or a metal bleacher which provides no cushioning. Other stadium seating may provide individual backrests and fold-down seats, but the fold-down seat portion often lacks any cushioning. It is not surprising, therefore, that many spectators become uncomfortable while watching lengthy sporting events. Some spectators deal with such problem by bringing their own pillows or cushions to the sporting event. However, in these instances, the spectator must carry the cushion or pillow to and from the stadium in addition to the other personal items desired by the spectator.

Sports bags have been proposed by others in the past in an attempt to deal with some of the problems noted above. For example, U.S. Pat. No. 4,515,300 issued to Cohen discloses a sports bag that may be converted to a bike bag, a shoulder bag, a belt bag, and a backpack. Similarly, U.S. Pat. No. 4,810,102 issued to Norton discloses a sport bag that can be worn as a shoulder bag, waist bag or backpack. However, the devices disclosed in such patents do not freeing the user of the burden of wearing such sports bag on the user's body while watching a sporting event. If such sports bag is removed from the user's body and placed under the user's seat, then the sports bag and its contents are subject to being damaged by spilled beverages and the like.

Within U.S. Pat. No. 5,275,315 to Carmack et al., a waist pack is disclosed wherein a seat cushion is coupled by a connecting strap to the waist pack. While this device serves to cushion what would otherwise be a hard seating surface, the device must nonetheless be worn by the user during the sporting event and provides little storage space for personal items. Similarly, U.S. Pat. No. 4,925,064 issued to Comora discloses a cushioning device for backpacks which doubles as a seat cushion; however, the backpack must still be worn or placed on the floor when the user is seated on the cushion.

U.S. Pat. No. 4,574,990 to Remis discloses a bag and carrier device used in conjunction with a folding stool, both to carry the stool and to hold articles. The carrier may include a handle, shoulder strap, or may be worn in the manner of a backpack. In one disclosed embodiment, flat cushions are sewn into the lining of the bag to provide padding applied to the stool seat to pad it. While such bag and carrier device is specially designed to be used in conjunction with an associated folding stool, the disclosed device is not adapted for use with conventional stadium seating, such as bleachers or fold-down stadium seats.

Accordingly, it is an object of the present invention to provide a durable pack for containing personal items of a spectator during a sporting event and which need not be worn by the user during the sporting event.

It is another object of the present invention to provide such a pack which suspends personal items above the stadium floor and safely away from spilled beverages and the like.

Still another object of the present invention is to provide such a pack which may include a cushion for softening an otherwise hard stadium seat, and which may be conveniently carried as part of the pack.

A further object of the present invention is to provide such a pack which may easily and conveniently carried or worn by a spectator when going to the stadium or when returning from the stadium.

A still further object of the present invention is to provide such a pack which is inexpensive to manufacture and which does not require modification of conventional stadium seating.

These and other objects of the present invention will become more apparent to those skilled in the art as the description of the present invention proceeds.

SUMMARY OF THE INVENTION

Briefly described and in accordance with preferred embodiments thereof, the present invention relates to a pack for containing personal items and for supporting such personal items below a stadium seat and above the stadium floor, and including a flexible sack having at least one pocket for containing such personal items. A closure is preferably provided for selectively sealing the opening of the pocket for allowing items to be inserted or removed from the pocket without allowing such items to fall out inadvertently. The pack of the present invention includes fasteners for suspending the pack below the lower surface of a stadium seat above the stadium flooring and out of the way, but within easy reach of the user.

The pack of the present invention preferably includes a handle or one or more straps for allowing a user to conveniently carry or wear the pack when walking to the stadium or returning home.

The fasteners for securing the pack below the stadium seat may include a series of hooked members for engaging opposing edges of the stadium seat. Such hooked members are preferably secured to the pack by elastic straps which keep tension on such hooked members for causing the hooked members to grip the edges of the stadium seat. Alternatively, supporting straps may extend from opposing ends of the pack for extending over and around opposing edges of the stadium seat; the free ends of such straps may extend over the upper surface of the stadium seat and are preferably secured to one another for suspending the pack immediately below the stadium seat.

The pack of the present invention may include a seat cushion having dimensions similar to those of at least one pocket formed by the sack. The cushion may be inserted within such pocket when not in use and can easily be carried to and from the stadium in such fashion. Alternatively, the seat cushion may be hingedly connected along one edge of the sack for extending above the stadium seat while the sack extends below the stadium seat. In this event, one end of the sack is supported by the hinged connection between the sack and the cushion, while the opposing end of the sack is supported by a fastening member.

The present invention also relates to a method for supporting a spectator at a stadium while providing storage space for the spectator's personal items. The method of the present invention includes providing a stadium seat and providing a flexible sack having at least one pocket containing the spectator's personal items. The spectator stores his or her personal items within the pocket of the sack and secures the sack immediately below the lower surface of a stadium seat. The spectator then proceeds to sit upon the upper surface of the stadium seat.

BRIEF DESCRIPTION OF THE DRAWINGS

FIG. 1 is perspective view of a sack constructed in accordance with the teachings of the present invention and including a pair of pockets and closure flap.

FIG. 2 is a rear view of the pack shown in FIG. 1.

FIG. 3 is a top view of a cushion adapted to be stored within, and used in conjunction with, the pack of FIG. 1.

DETAILED DESCRIPTION OF THE PREFERRED EMBODIMENTS

Figure 6:
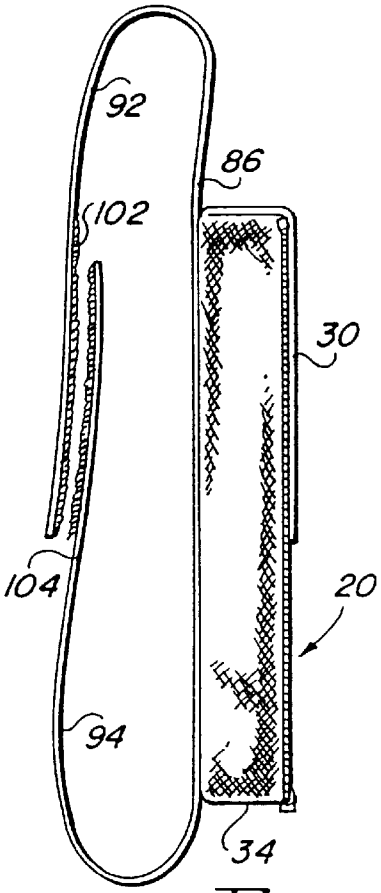
FIG. 6 is a side view of the pack shown in FIG. 5 and illustrating how the fastening straps shown in FIG. 5 may be fastened to form a backpack in order to more conveniently carry such pack to and from a sporting event.

A pack constructed in accordance with a preferred embodiment of the present invention is shown in FIG. 1 and is designated generally by reference numeral 20. Pack 20 is preferably constructed of a flexible fabric material such as canvas or nylon, and is preferably coated with a waterproofing material for moisture resistance. The various components and panel forming such pack may be sewn together using the same techniques currently used by manufacturers of backpacks.

As indicated in FIG. 1, pack 20 is generally rectangular in shape and includes a pair of opposing sidewalls 22 and 24, a rear panel 26, and a front panel 28. Rear panel 26 extends for a greater length than front panel 28 in order to provide a closure flap 30 that can be folded down over front panel 28. The space bounded by front panel 28, rear panel 26 and side walls 22 and 24 forms a first pocket 32 of a flexible sack which may be used to store personal items. Though not shown in FIG. 1, pocket 32 is also bounded by a bottom wall, designated as reference numeral 34 within FIG. 6. As shown in FIG. 1, a second pocket 36 may be formed by sewing the side and bottom edges of a second flexible sheet of material 38 to the side and bottom edges of front panel 28. The larger pocket 32 is adapted to receive a correspondingly sized seat cushion 40 shown in FIG. 3. Both pockets 32 and 36 may be used to store personal items of the user.

Figure 4:
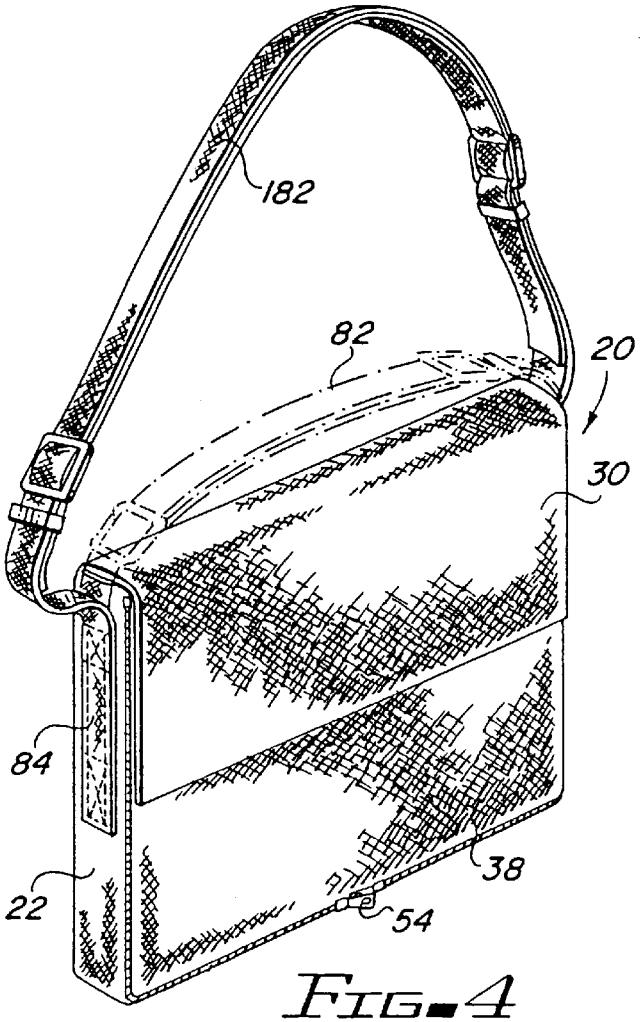
FIG. 4 is a perspective view of the pack of FIG. 1 showing the closure flap in a sealed position and including a handle or shoulder strap for use in carrying the pack to or from a sporting event.

In order to releasably seal closure flap 30, and thereby seal the openings to pockets 32 and 36, hook-and-loop fastening material such as that sold under the trademark "VELCRO" is preferably used. Three sections of loop-style fabric 42, 44, and 46 are secured to panel 38, as shown in FIG. 1. Corresponding lengths of hook-style material 48, 50 and 52 are secured to the inner portion of closure flap 30 along the upper end thereof. When closure flap 30 is folded over panel 38 of pack 20, as shown in FIG. 4, hook-style material 48 mates with loop-style material 42 to form a releasable closure. Likewise, hook-style material portions 50 and 52 engage loop-style portions 44 and 46 in order to maintain closure flap 30 in its sealed position.

If desired, pocket 32 may be expandable. In this event, a portion of side wall 22 is doubled over to form a pleat extending within pocket 32. A similar pleat is formed along opposing sidewall 24. A pair of zippers 54 and 56 can be unzipped by the user to selectively include such pleated portions within the exposed portions of sidewalls 22 and 24, thereby widening the exposed portions of sidewalls 22 and 24 in order to expand the size of pocket 32.

As indicated above, pack 20 includes a fastening system for releasably securing flexible pack 20 to the underside of a stadium seat. One preferred embodiment of such fastening system is shown in FIG. 2. A pair of hooked members 58 and 60 are each secured proximate the lower portion of rear sheet 26 of the pack by elastic straps 62 and 64, respectively. Elastic straps 62 and 64 are secured to rear sheet 26 by reinforced stitched area 66 and 68, respectively; these reinforced stitched areas prevent pack 20 from becoming deformed when tension is placed on elastic straps 62 and 64. Likewise, upper hooked members 70 and 72 are attached by corresponding elastic straps 74 and 76 to the upper portion of rear sheet 26, again by reinforced stitched portion 78 and 80, respectively. The manner by which such hooked members and elastic straps are used to secure pack 20 below a stadium seat is described in greater detail below in conjunction with FIGS. 7A, 7B, 8 and 9.

As shown in FIG. 4, a handle strap 82, shown in dashed outline, may be secured to the opposing upper ends of side walls 22 and 24. Handle strap 82 can be grasped by the user for allowing the user to more conveniently carry pack 20 to or from a stadium. As is further indicated in FIG. 4, such handle strap may be adjustable in length, and the user can lengthen such strap to provide a shoulder strap 182, shown in solid outline, for extending about a user's shoulder. Handle strap 82 (or shoulder strap 182) may be stitched to side walls 22 and 24, as indicated by reference numeral 84 in FIG. 4.

Figure 5:
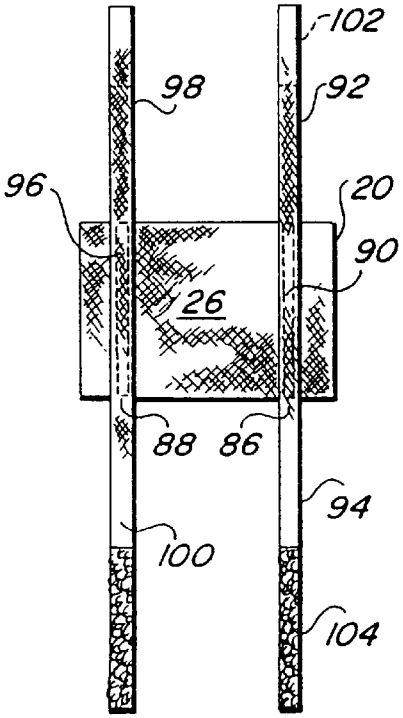
FIG. 5 is an alternate embodiment of the pack shown in FIG. 1 including a pair of fastening straps which may be used to secure the pack to the underside of a stadium seat.

In an alternate embodiment shown in FIGS. 5 and 6, a pair of straps 86 and 88 are attached to pack 20 and serve the dual purpose of securing pack 20 to a stadium seat as well as providing backpack-like straps for allowing a user to extend the user's hands through such pair of straps 86 and 88 in order to wear pack 20 upon the user's back when travelling to or from the stadium. First strap 86 is secured by stitching 90 to the rear sheet 26 of pack 20 along one side thereof and includes a first length 92 that extends upwardly and a second length 94 that extends downwardly, as shown in FIG. 5. Likewise, second strap 88 is secured by stitching 96 to the rear sheet 26 of pack 20 along the opposing side thereof and includes a first length 98 that extends upwardly and a second length 100 that extends downwardly. As indicated in FIGS. 5 and 6, the end of first length 92 of first strap 86 is provided with a portion 102 of hook style fastening material, and the end of second length 94 of first strap 86 is provided with a mating portion 104 of loop style fastening material. The ends of first and second lengths 92 and 94 can be overlapped with each other to bring fastening portion 102 in contact with fastening portion 104 to form first strap 86 into a loop, as shown in FIG. 6. In a similar manner, second strap 88 may be formed into a second loop. In this manner, straps 86 and 88 can form a pair of shoulder straps to secure pack 20 on the user's back when walking to or from the stadium. As will be described in greater detail below in conjunction with FIGS. 10 and 11, straps 86 and 88 may also be used to secure pack 20 below stadium seating.

Figure 7B:
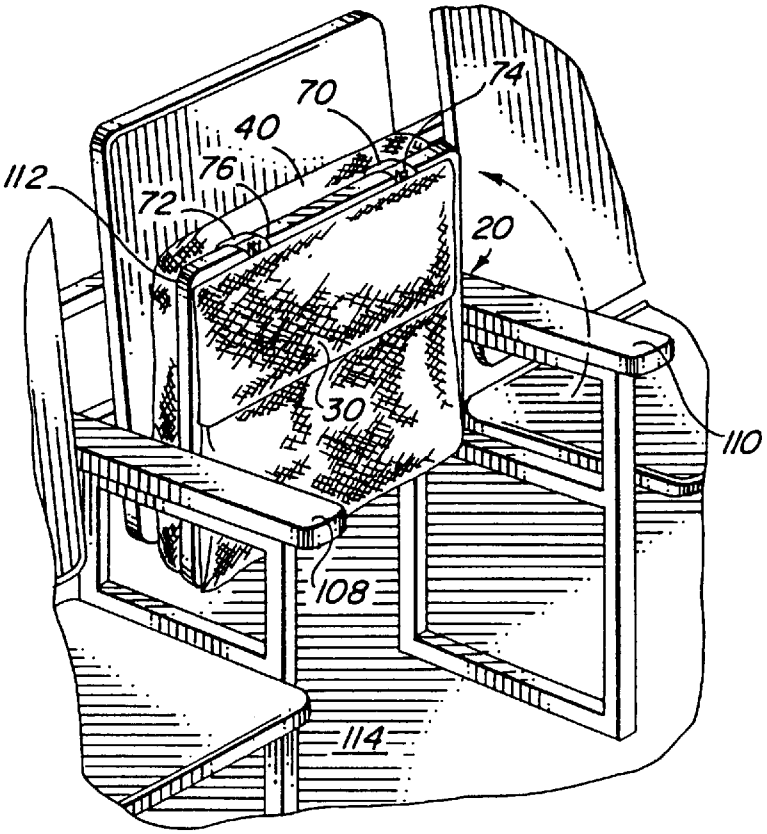
FIG. 7B is a perspective view of the stadium seat and pack secured thereto after such stadium seat is allowed to retract to its unused position.
Figure 7A:
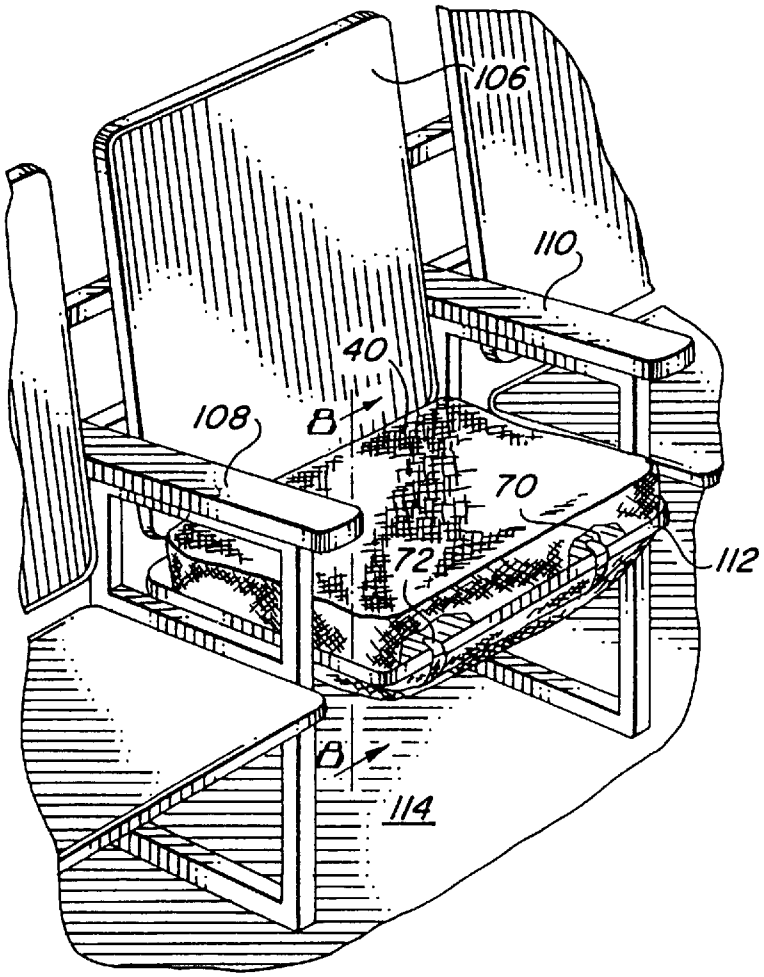
FIG. 7A is a perspective view of a fold-down stadium seat wherein the pack of the present invention is secured below such seat and a cushion is placed above such seat.
Figure 9:
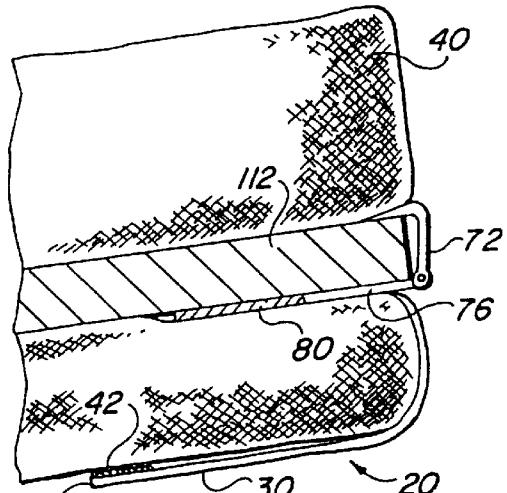
FIG. 9 is an enlarged view of the forwardmost portion of the stadium seat shown in FIG. 8 as designated by dashed circle 9 within FIG. 8.
Figure 8:
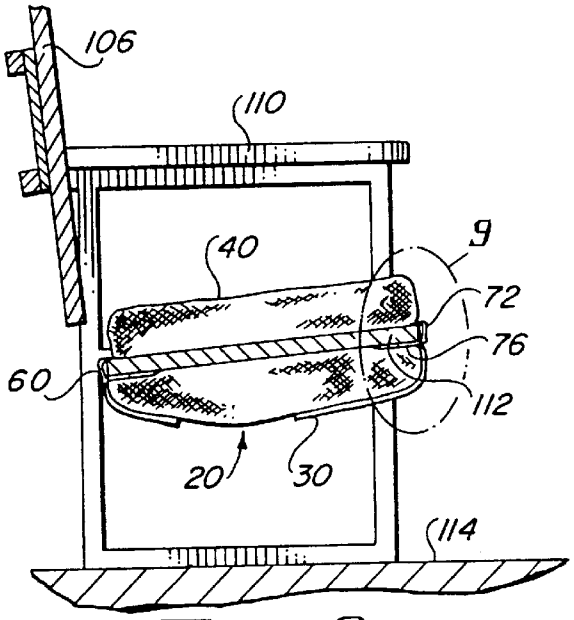
FIG. 8 is a side sectional view of the stadium seat and pack shown in FIG. 7A.

FIGS. 7A, 7B and 8 illustrate one common form of stadium seating wherein each seating area includes a fixed backrest 106, a pair of fixed armrests 108 and 110, and a pivoting seat 112. FIGS. 7A and 8 show the pivoting seat 112 in the lowered, or horizontal position, for supporting a spectator; FIG. 7B shows seat 112 in the raised, or vertical position, as when such seat is not presently occupied.

In order to secure pack 20 to the bottom of seat 112 when pack 20 is provided with the hooked members shown in FIG. 2, the user first positions seat 112 in its raised position shown in FIG. 7B; the user then supports pack 20 with its rear face 26 facing the underside of seat 112 and engages lower hooked members 58 and 60 behind and around the rear edge of stadium seat 112. The user then pulls upper hooked 70 and 72 over and around the front edge of the stadium seat, stretching elastic straps 62, 64, 74 and 76 in the process. Elastic straps 62, 64, 74 and 76 stretch not only to accommodate stadium seats of different dimensions, but also to maintain tension on hooked members 58, 60, 70 and 72 to prevent such hooked members from falling off the edges of stadium seat 112 until they are intentionally pulled off by the user at the end of the sporting event. In this manner, pack 20 is supported immediately below the user's seat, safely above the stadium floor 114. Moreover, if the user desires access to the contents of pack 20 during the sporting event, the user simply raises seat 112 and releases closure flap 30 without the need for removing pack 20 from the stadium seat. As indicated in FIGS. 7A, 7B, 8 and 9, optional cushion 40 may be removed from pocket 32 and placed upon seat 112 to cushion seat 112.

While FIGS. 7A, 7B, 8 and 9 show pack 20 being secured to a fold-down stadium seat, those skilled in the art will appreciate that the hooked members 58, 60, 70 and 72 may also be engaged around the front and rear edges of bleacher seating. In this event, the user temporarily supports pack 20 against the underside of the bleacher and engages lower hooked members 58 and 60 under and around the rear edge of the bleacher. The user then pulls upper hooked members 70 and 72 forwardly, stretching elastic straps 62, 64, 74 and 76 until upper hooked members extend around the front edge of the bleacher.

Figure 11:
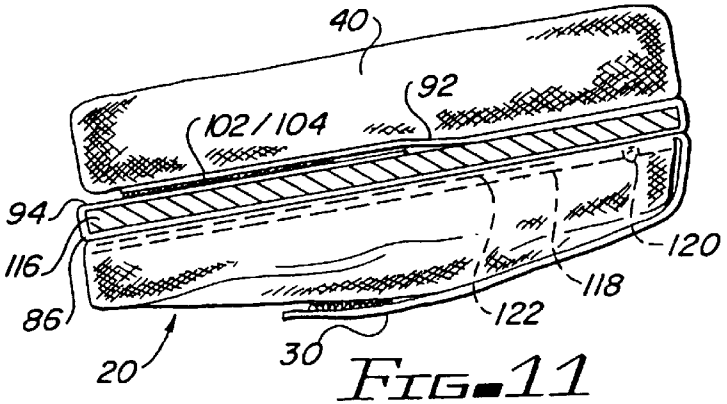
FIG. 11 shows a similar embodiment to that shown in FIG. 10 except that the fastening straps extend below the spectator's cushion.
Figure 10:
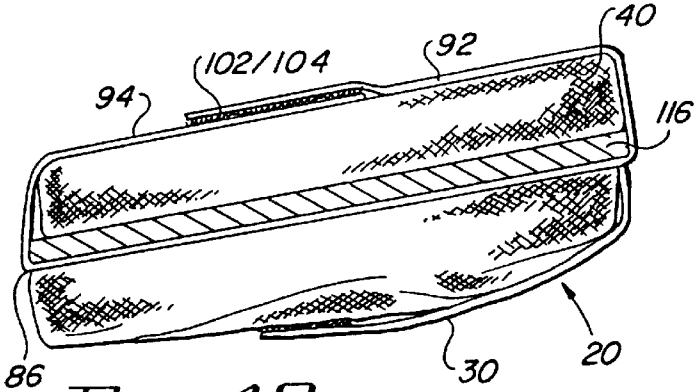
FIG. 10 illustrates an alternate embodiment of the pack as shown in FIG. 5 using fastening belts extending entirely around the stadium seat to secure both the pack and pillow to the stadium seat.

In FIGS. 10 and 11, the embodiment of the present invention represented by FIGS. 5 and 6 is shown fastened to the bottom of a stadium seat surface 116 , which may be either a fold-down stadium seat, like that shown as 112 in FIGS. 7A/7B, or a bleacher. In FIG. 10, fastening strap 86 serves both to support pack 20 from the underside of seat surface 116 and to secure cushion 40 to the seat. The second length 94 of first strap 86 extends upwardly around the rear edge of seat surface 116 over the upper surface of cushion 40. The first length 92 of first strap 86 extends upwardly around the front edge of seat surface 116 and over the upper surface of cushion 40. The mating hook and loop portions 102 and 104 of first length 92 and second length 94, respectively are engaged with each other to tighten strap 86 around seat surface 116 and around cushion 40. While not shown in FIG. 10, second strap 88 (see FIG. 5) is secured in the same manner about seat surface 116 and cushion 40. Once again, closure flap 30 is accessible and may be released by the user to gain access to the pockets of pack 20 without requiring that pack 20 be removed from seat surface 116.

In FIG. 11, pack 20 is secured below seat surface 116 in the same manner described in conjunction with FIG. 10, except that first and second lengths 92 and 94 are secured to each other directly above seat surface 116 before cushion 40 is placed upon seat surface 116. This method of securing pack 20 to the underside of seat surface 116 allows cushion 40 to be moved, or omitted entirely.

Also indicated within FIG. 11 in dashed outline is an optional water-resistant pouch designated by reference numeral 118. Water resistant pouch 118 is disposed within the inner pocket of pack 20, and preferably includes a zipper-type fastener 120 located near the opening of pack 20 for allowing pouch 118 to be opened and subsequently resealed. This pouch may be made of stiffened plastic, and zipper-type fastener 120 may be of the same type often used to seal plastic freezer bags and/or pencil cases. Pouch 118 is particularly useful for storing programs (indicated in dashed outline by reference numeral 122), trading cards, or other collectibles.

Those skilled in the art will now appreciate that a pack has now been described for containing personal items of a spectator during a sporting event and which suspends personal items above the stadium floor and safely away from spilled beverages and the like. The disclosed pack need not be worn by the user during the sporting event, and may include a cushion for softening an otherwise uncomfortable hard stadium seat; the cushion may be conveniently carried as part of the pack. The disclosed pack may easily be carried by a spectator heading toward, or returning from, the stadium. In addition, the disclosed pack can be manufactured inexpensively and is adapted to engage conventional seating surfaces utilized at sporting stadiums. Furthermore, those skilled in the art will appreciate that an improved method for securing personal items below a stadium seat has now been described.

The present invention has been described herein with sporting events particularly in mind; however, those skilled in the art will appreciate that the disclosed pack may be used at other public events, such as at the circus, ice shows, movie theaters, and the like. While the present invention has been described with respect to preferred embodiments thereof, such description is for illustrative purposes only, and is not to be construed as limiting the scope of the invention. For example, it may be desired to hingedly attach one edge of cushion 40 to the top or bottom of pack 20; in this manner, one end of pack 20 could be supported below the stadium seat by the hinged coupling to cushion 40 placed above the stadium seat. The opposing end of pack 20 could then be supported by a strap releasably secured to the opposing edge of cushion 40. If desired, ornamentation may be applied to the pack, such as team logos, business logos, or other designs. Closure flap 30 and its associated hook-and-loop fasteners could be replaced by a zippered closure mechanism, if desired. Various other modifications and changes may be made to the described embodiments by those skilled in the art without departing from the true spirit and scope of the invention as defined by the appended claims.

I claim:

1. A pack for containing personal items and for supporting such personal items below a stadium seat, said pack comprising in combination:

a. a flexible sack having at least one pocket for containing personal items and having at least one opening providing access to the pocket, said sack including first and second opposing ends;

b. closure means secured to said flexible sack for releasably sealing said at least one opening for inserting personal items into, or removing personal items from, said at least one pocket; and c. securing means attached to said flexible sack for releasably securing said flexible sack below a stadium seat, said securing means including at least one first hooked member secured to a first end of said sack for engaging a first edge of a stadium seat, and said securing means including at least a second hooked member secured to a second opposing end of said sack for engaging a second edge of a stadium seat.

2. The pack recited by claim 1 including at least one elastic member secured between said sack and one of said first and second hooked members.

3. An apparatus for supporting a spectator at a stadium while providing storage space for personal items, said apparatus comprising in combination:

a. a stadium seat having an upper surface for supporting a spectator's body and an opposing lower surface;

b. a flexible sack having at least one pocket for containing personal items and having at least one opening providing access to the pocket;

c. closure means secured to said flexible sack for releasably sealing said at least one opening for inserting personal items into, or removing personal items from, said at least one pocket; and d. securing means attached to said flexible sack for releasably securing said flexible sack immediately below and substantially against the lower surface of said stadium seat.

4. The apparatus recited by claim 3 wherein:

a. said stadium seat includes at least a first edge and an opposing second edge; and b. said securing means includes a first fastening member secured to said sack for extending about the first edge of said stadium seat, and said securing means including a second fastening member secured to said sack for extending about the second opposing edge of said stadium seat.

5. An apparatus for supporting a spectator at a stadium while providing storage space for personal items, said apparatus comprising in combination:

a. a stadium seat having an upper surface for supporting a spectator's body and an opposing lower surface, said stadium seat including at least a first edge and an opposing second edge;

b. a flexible sack having at least one pocket for containing personal items and having at least one opening providing access to the pocket;

c. closure means secured to said flexible sack for releasably sealing said at least one opening for inserting personal items into, or removing personal items from, said at least one pocket; and d. securing means attached to said flexible sack for releasably securing said flexible sack immediately below the lower surface of said stadium seat, said securing means including a first fastening member secured to said sack for extending about the first edge of said stadium seat, and said securing means including a second fastening member secured to said sack for extending about the second opposing edge of said stadium seat, wherein said first and second fastening members each include a hooked member for engaging the first and second edges, respectively, of said stadium seat.

6. The apparatus recited by claim 5 wherein at least one of said first and second fastening members includes an elastic strap for attaching the hooked member thereof to said sack.

7. An apparatus for supporting a spectator at a stadium while providing storage space for personal items, said apparatus comprising in combination:

a. a stadium seat having an upper surface for supporting a spectator's body and an opposing lower surface, said stadium seat including at least a first edge and an opposing second edge;

b. a flexible sack having at least one pocket for containing personal items and having at least one opening providing access to the pocket;

c. closure means secured to said flexible sack for releasably sealing said at least one opening for inserting personal items into, or removing personal items from, said at least one pocket; and d. securing means attached to said flexible sack for releasably securing said flexible sack immediately below and substantially against the lower surface of said stadium seat and substantially against, said securing means including a first fastening member secured to said sack for extending about the first edge of said stadium seat, and said securing means including a second fastening member secured to said sack for extending about the second opposing edge of said stadium seat, wherein said first and second fastening members include first and second straps extending over the upper surface of said stadium seat for being secured to each other.

8. A method for supporting a spectator at a stadium while providing storage space for personal items, said method comprising the steps of:

a. providing a stadium seat having an upper surface for supporting a spectator's body and an opposing lower surface;

b. providing a flexible sack having at least one pocket for containing personal items and having at least one opening providing access to the pocket;

c. storing the spectator's personal items within the at least one pocket of the flexible sack;

d. securing the flexible sack against the lower surface of the stadium seat; and e. seating the spectator upon the upper surface of the stadium seat.

9. The method recited by claim 8 wherein the step of securing the flexible sack against the lower surface of the stadium seat includes the step of extending a first fastening member secured to said sack about a first edge of the stadium seat, and extending a second fastening member secured to said sack about a second opposing edge of the stadium seat.

* * * * *